US009555990B2

(12) United States Patent
Kanetoku

(10) Patent No.: US 9,555,990 B2
(45) Date of Patent: Jan. 31, 2017

(54) PRINTING APPARATUS, SHEET RESIDUAL QUANTITY DETERMINATION METHOD AND NON-TEMPORARY RECORDING MEDIUM

(71) Applicant: TOSHIBA TEC KABUSHIKI KAISHA, Shinagawa-ku, Tokyo (JP)

(72) Inventor: Ryosuke Kanetoku, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/666,775

(22) Filed: Mar. 24, 2015

(65) Prior Publication Data

US 2016/0279990 A1 Sep. 29, 2016

(51) Int. Cl.

| | |
|---|---|
| ***B65H 7/14*** | (2006.01) |
| ***B41J 29/38*** | (2006.01) |
| ***B65H 7/04*** | (2006.01) |
| ***B41J 13/00*** | (2006.01) |
| ***B41J 13/10*** | (2006.01) |
| ***B65H 7/02*** | (2006.01) |
| ***B65H 7/00*** | (2006.01) |

(52) U.S. Cl.

CPC ..... *B65H 7/14* (2013.01); *B41J 13/00* (2013.01); *B41J 13/10* (2013.01); *B41J 13/103* (2013.01); *B41J 29/38* (2013.01); *B65H 7/00* (2013.01); *B65H 7/02* (2013.01); *B65H 7/04* (2013.01); *B65H 2511/152* (2013.01); *B65H 2511/51* (2013.01); *B65H 2511/515* (2013.01)

(58) Field of Classification Search

CPC ..... B65H 2511/51; B65H 2511/515; B65H 7/04; B65H 7/02; B65H 7/00; B65H 7/14; B65H 2511/152; B41J 13/00; B41J 13/10; B41J 13/103

See application file for complete search history.

(56) References Cited

U.S. PATENT DOCUMENTS

| | | | | |
|---|---|---|---|---|
| 4,888,617 | A * | 12/1989 | Okuzawa | G03G 15/6502 271/110 |
| 2010/0074637 | A1* | 3/2010 | Shiraishi | B65H 1/266 399/23 |
| 2015/0197402 | A1* | 7/2015 | Yamaoka | B65H 7/02 271/153 |
| 2016/0167410 | A1* | 6/2016 | Takada | B41J 11/0095 347/16 |

FOREIGN PATENT DOCUMENTS

| | | |
|---|---|---|
| JP | 07-187445 | 7/1995 |
| JP | 2004-269233 | 9/2004 |

OTHER PUBLICATIONS

Machine translation of JP 07-187445 A. (JP 07-187445 A was published on Jul. 25, 1995.).*

Machine translation of JP 2004-269233 A. (JP 2004-269233 A was published on Sep. 30, 2004.).*

* cited by examiner

*Primary Examiner* — Justin Seo

(74) *Attorney, Agent, or Firm* — Amin, Turocy & Watson LLP

(57) ABSTRACT

In accordance with one embodiment, a printing apparatus comprises a light receiving section, a determination section and a printing section. The light receiving section receives light emitted from a light emitting section which emits light, and detects a voltage level corresponding to the quantity of the received light. The determination section determines the residual quantity of sheets according to the detected voltage level. The printing section carries out printing on a sheet.

12 Claims, 5 Drawing Sheets

| DETERMINATION CONDITION | DETERMINATION | |
|---|---|---|
| V1≦VL | SUFFICIENT STOCK | 30 |
| V2≦VL<V1 | INSUFFICIENT STOCK | 30 |
| VL<V2 | NO STOCK | 30 |

PRINTING APPARATUS, SHEET RESIDUAL QUANTITY DETERMINATION METHOD AND NON-TEMPORARY RECORDING MEDIUM

FIELD

Embodiments described herein relate generally to a printing apparatus, a sheet residual quantity determination method and a non-temporary recording medium.

BACKGROUND

Conventionally, in a printing apparatus such as a barcode printer and the like, printing is carried out on a sheet-like image receiving medium (hereinafter referred to as a "sheet") such as paper, and then the printed sheet is issued. The sheet to be subjected to printing processing by the printing apparatus is stored in a paper tray in the printing apparatus. Conventionally, a PE sensor (transmission sensor) and a plastic plate are arranged, and the existence of detection of the light emitted from the PE sensor is used to determine the existence of the sheet stored on the paper tray.

However, in a conventional printing apparatus, the degree of the residual quantity of the sheets cannot be detected. Thus, sheets are not replenished until the sheets stored on the paper tray are used up; as a result, downtime occurs frequently. Such a problem occurs not only in the printing apparatus but also in other apparatuses in which sheets are stored in a paper tray.

DETAILED DESCRIPTION

In accordance with one embodiment, a printing apparatus comprises a light receiving section, a determination section and a printing section. The light receiving section receives light emitted from a light emitting section which emits light, and detects a voltage level corresponding to the quantity of the received light. The determination section determines the residual quantity of sheets according to the detected voltage level. The printing section carries out printing on a sheet.

Hereinafter, the printing apparatus according to the embodiment is described in detail with reference to the accompanying drawings.

Figure 1:
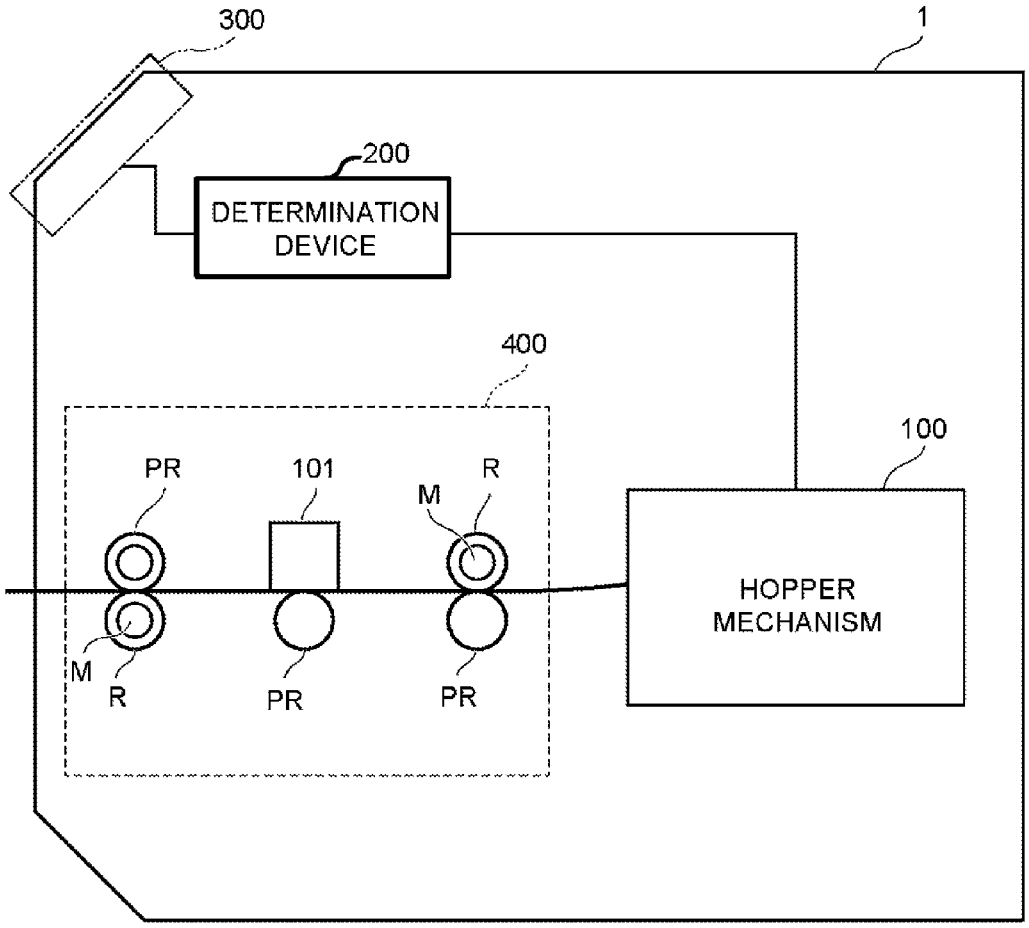
FIG. 1 is a diagram illustrating an example of the constitution of a printing apparatus 1 according to one embodiment.

FIG. 1 is a diagram illustrating an example of the constitution of a printing apparatus 1 according to the embodiment.

The printing apparatus 1 carries out printing on a sheet and then issues the printed sheet. In the present embodiment, cut paper is used as an example of the sheet.

The printing apparatus 1 is provided with a hopper mechanism 100, a determination device 200, a display section 300 and a printing conveyance section 400.

The hopper mechanism 100 conveys the sheet. For example, the hopper mechanism 100 feeds and conveys the sheet to the printing conveyance section 400. The hopper mechanism 100 detects information (hereinafter referred to as "residual quantity determination information") for determining the residual quantity of the sheets.

The determination device 200 determines the residual quantity of the sheets based on the residual quantity determination information detected by the hopper mechanism 100.

The display section 300 is an image display device such as a liquid crystal display, an organic EL (Electro Luminescence) display and the like. The display section 300 operates as an output interface to display characters and images. For example, the display section 300 displays a determination result of the determination device 200. The display section 300 further operates as an input interface to receive an instruction input from a user.

The printing conveyance section 400 includes a plurality of motors M, a plurality of platen rollers PR, a plurality of conveyance rollers R and a printing section 101.

The motors M drive the conveyance rollers R to convey the sheet.

The platen rollers PR are arranged opposite to the conveyance rollers R and the printing section 101. The platen rollers PR press the sheet so that the sheet is conveyed properly on a conveyance path RT. The sheet is conveyed to a discharge port along the conveyance path RT through the conveyance rollers R and the platen rollers PR.

The printing section 101, which is, for example, a thermal head, carries out printing on the sheet conveyed from the hopper mechanism 100. The printing section 101 is arranged above the platen roller PR in a manner of being opposite to the platen roller PR. The printing section 101 includes a plurality of heat generating elements arranged in a line, and selectively energizes the plurality of heat generating elements to generate heat through the heat generating elements. The printing section 101 melts or sublimates the ink of an ink ribbon through the heat generated by the heat generating elements and transfers the ink to the sheet to carry out printing on the sheet.

Figure 2:
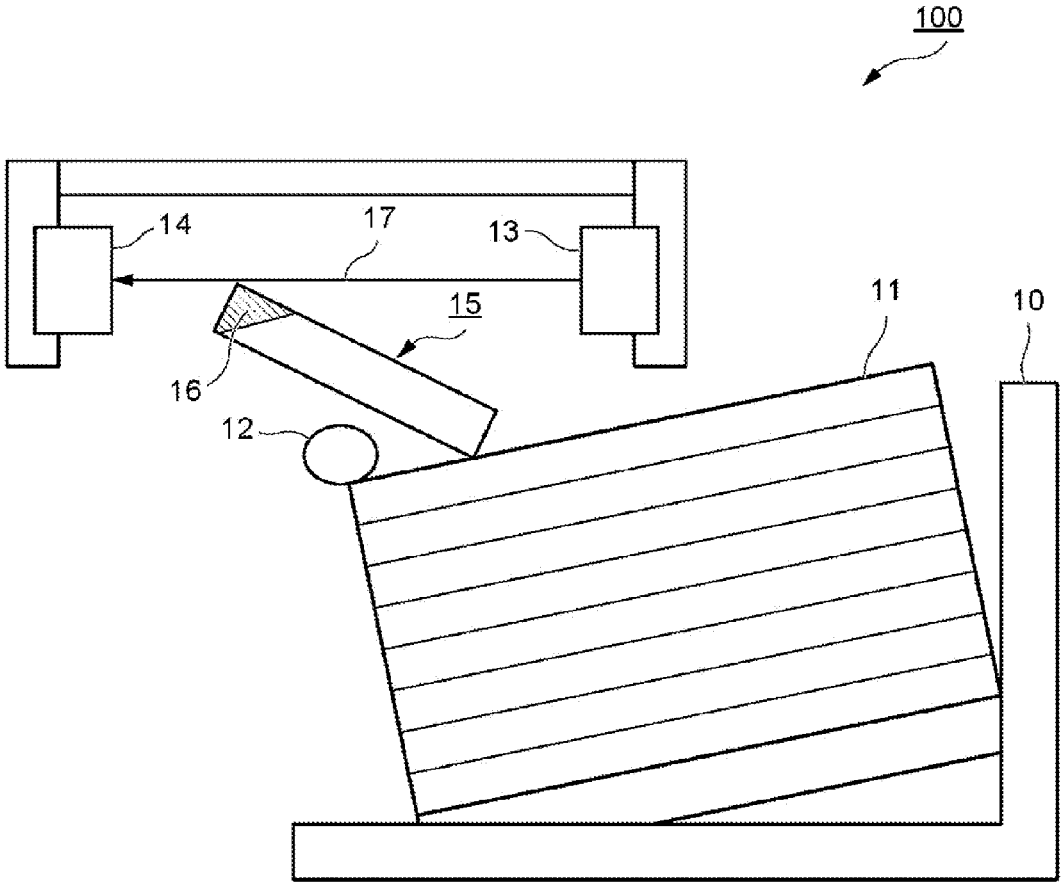
FIG. 2 is a diagram illustrating the specific constitution of a hopper mechanism 100.

FIG. 2 is a diagram illustrating the specific constitution of the hopper mechanism 100.

As shown in FIG. 2, the hopper mechanism 100 includes a sheet feed tray 10, a sheet feed roller 12, a light emitting section 13, a light receiving section 14 and a light shielding section 15.

The sheet feed tray 10 is a table for placing sheets 11 to be printed.

The sheet feed roller 12 feeds the sheet 11 placed on the sheet feed tray 10 to the conveyance path RT one by one.

The light emitting section 13 is arranged opposite to the light receiving section 14. The light emitting section 13 emits light to the light receiving section 14 regularly. In the following description, a passage where the light emitted by the light emitting section 13 passes is referred to as a light passage 17.

The light receiving section 14 receives the light emitted from the light emitting section 13, and detects the voltage level corresponding to the quantity of the received light. The voltage level corresponds to the residual quantity determination information. The light receiving section 14, if receiving no light emitted from the light emitting section 13 for a pre-determined time, detects no voltage level (for example, 0).

The light shielding section 15 is arranged between the light emitting section 13 and the light receiving section 14, and the inclination thereof changes according to the residual quantity of the sheets 11. For example, the more the residual quantity of the sheets 11 is (the closer to the maximum quantity of sheets that can be stored in the sheet feed tray 10), the more the longitudinal direction of the light shielding section 15 approaches parallel to the light passage 17. On the other hand, the less the residual quantity of the sheets 11 is (the closer the residual quantity of the sheets 11 is to 0), the more the longitudinal direction of the light shielding section 15 approaches perpendicular to the light passage 17. As stated above, the light shielding section 15 changes in inclination according to the residual quantity of the sheets 11.

The light shielding section 15 includes a light transmissive part 16 through which light can be transmitted at a pre-determined area. In the example shown in FIG. 2, the light shielding section 15 includes a triangular light transmissive part 16 (shaded area in FIG. 2) at one end. The light transmissive part 16 is such a material through which light is transmitted and the transmitted light is attenuated. For example, the light transmissive part 16 is glass (excluding light shielding glass) or light transmissive plastic and the like. The light transmissive part 16 may be other materials than glass or plastic as long as it is a material through which light is transmitted and the transmitted light is attenuated.

In a case in which the thickness of the residual quantity of the sheets 11 is greater than a first threshold value, the light transmissive part 16 is located at a position where it does not intersect with the light passage 17. Thus, in a case in which the thickness of the residual quantity of the sheets 11 is greater than the first threshold value, the light emitted from the light emitting section 13 reaches to the light receiving section 14 without being attenuated.

On the other hand, in a case in which the thickness of the residual quantity of the sheets 11 is smaller than the first threshold value, the light transmissive part 16 is located at a position where it intersects with the light passage 17. Thus, in a case in which the thickness of the residual quantity of the sheets 11 is smaller than the first threshold value, the light emitted from the light emitting section 13 is attenuated by the light transmissive part 16 and then reaches to the light receiving section 14.

The light shielding section 15 shields the light in a case in which the thickness of the residual quantity of the sheets 11 is smaller than a second threshold value. In this case, the light emitted from the light emitting section 13 does not reach to the light receiving section 14. Incidentally, the second threshold value is smaller than the first threshold value.

As stated above, in a case in which the thickness of the residual quantity of the sheets 11 is greater than the second threshold value and smaller than the first threshold value, the light transmissive part 16 is located at a position where it intersects with the light passage 17. The light shielding section 15 provided with the light transmissive part 16 can change the quantity of the light emitted from the light emitting section 13 according to the inclination thereof.

In the following description, the part of the light shielding section 15 excluding the light transmissive part 16 is referred to as a light shielding part. The light shielding part shields the light emitted from the light emitting section 13.

Figures 3, 4:
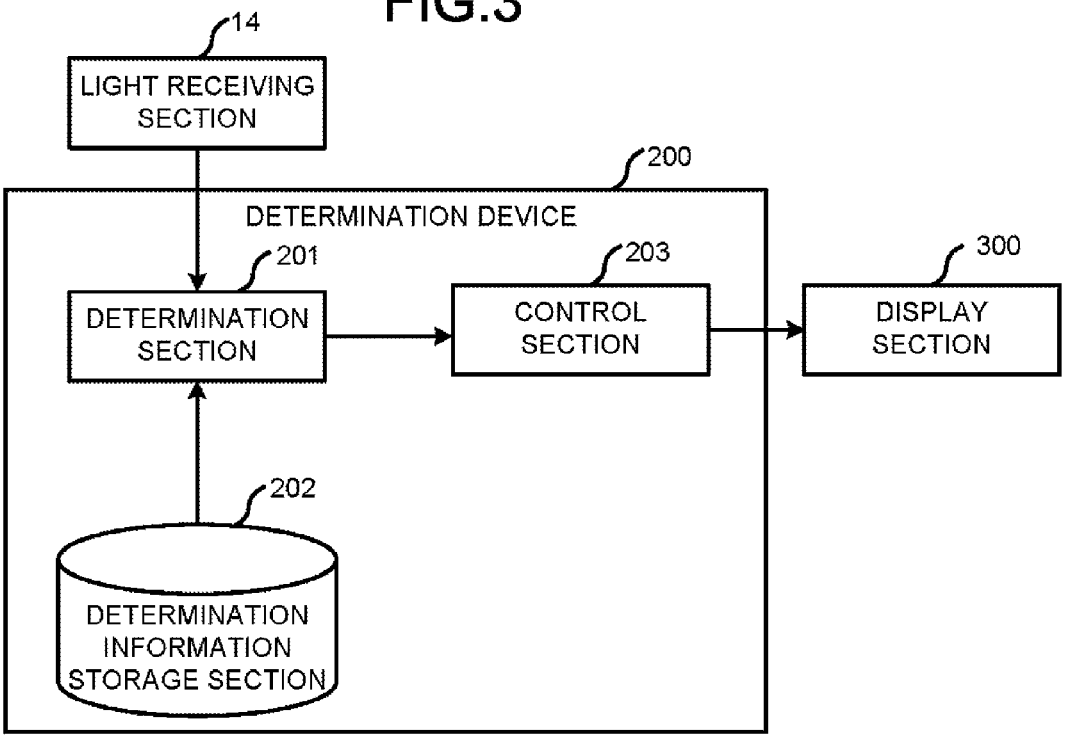
FIG. 3 is a schematic block diagram illustrating the functional components of a determination device 200.
FIG. 4 is a diagram illustrating a specific example of a determination information table.

FIG. 3 is a schematic block diagram illustrating the functional components of the determination device 200.

The determination device 200, which is equipped with a CPU (Central Processing Unit), a memory and an auxiliary storage device and the like connected through a bus line, executes a determination program to function as a device provided with a determination section 201, a determination information storage section 202 and a control section 203. All or part of the functions of the determination device 200 may be realized using hardware such as ASIC (Application Specific Integrated Circuit), PLD (Programmable Logic Device), FPGA (Field Programmable Gate Array) and the like. The determination program may be recorded in a computer-readable recording medium. The computer-readable recording medium includes a portable medium such as flexible disk, magnetic optical disk, ROM, CD-ROM and the like, and a storage device such as a hard disk drive arranged inside a computer system. The determination program may be sent or received through an electric communication line.

The determination section 201 determines the residual quantity of the sheets 11 based on the information stored in the determination information storage section 202 and the voltage level detected by the light receiving section 14. The determination processing by the determination section 201 is carried out at a pre-determined timing. The pre-determined timing refers to, for example, the timing after one sheet 11 is issued, or the timing after a pre-determined number of sheets 11 is issued. The pre-determined timing may be other timing than the timing listed above.

The determination information storage section 202 consists of a storage device such as a magnetic hard disk drive device or a semiconductor storage device and the like. The determination information storage section 202 stores a determination information table. The determination information table consists of a record (hereinafter referred to as a "determination information record") including information relating to the determination of the residual quantity of the sheets 11.

The control section 203 controls each function section of the determination device 200. For example, the control section 203 displays the determination result of the determination section 201 on the display section 300.

FIG. 4 is a diagram illustrating a specific example of the determination information table. The determination information table includes a plurality of determination information records 30. The determination information record 30 includes each value of a determination condition and determination (index). The value of the determination condition indicates the condition for determining the residual quantity of the sheets 11 at a pre-determined timing. The value of the determination indicates the residual quantity of the sheets 11 in a case in which the condition of the same determination information record 30 is met.

In the example shown in FIG. 4, the information of a plurality of determination conditions is registered in the determination information table. These determination conditions include "$V1 \leq VL$", "$V2 \leq VL < V1$" and "$VL < V2$". VL refers to the voltage level. In FIG. 4, in the determination information record 30 registered at the upmost stage of the determination information table, the value of the determination condition is "$V1 \leq VL$", and the value of the determination is "sufficient stock". That is, in a case in which the voltage level is greater than a pre-determined value V1, the determination section 201 determines that the stock of the sheets 11 placed on the sheet feed tray 10 is sufficient, which means there are so many sheets 11 placed on the sheet feed tray 10 and that there is no need to replenish the sheet. That is, in a case in which the stock is sufficient, the thickness of the residual quantity of the sheets 11 is greater than the first threshold value. Incidentally, the value of V1 may be preset or be properly changed by the user.

In FIG. 4, in the determination information record 30 registered at the second stage of the determination information table, the value of the determination condition is "V2≤VL<V1", and the value of the determination is "insufficient stock". That is, in a case in which the voltage level is greater than a pre-determined value V2 and is smaller than V1, the determination section 201 determines that the stock of the sheets 11 placed on the sheet feed tray 10 is insufficient. Incidentally, the value of V2 may be preset or be properly changed by the user. The value of V2 is smaller than the value of V1.

In FIG. 4, in the determination information record 30 registered at the third stage of the determination information table, the value of the determination condition is "VL<V2", and the value of the determination is "no stock". That is, in a case in which the voltage level is smaller than V2, the determination section 201 determines that there is no stock of the sheets 11 placed on the sheet feed tray 10.

The determination section 201 confirms the voltage level detected by the light receiving section 14 at pre-determined timing. The determination section 201 determines the residual quantity of the sheets by three stages according to the confirmed voltage level by reference to the determination information table described above.

Next, the difference corresponding to the inclination of the light shielding section 15 is described with reference to FIG. 5 and FIG. 6.

Figure 5:
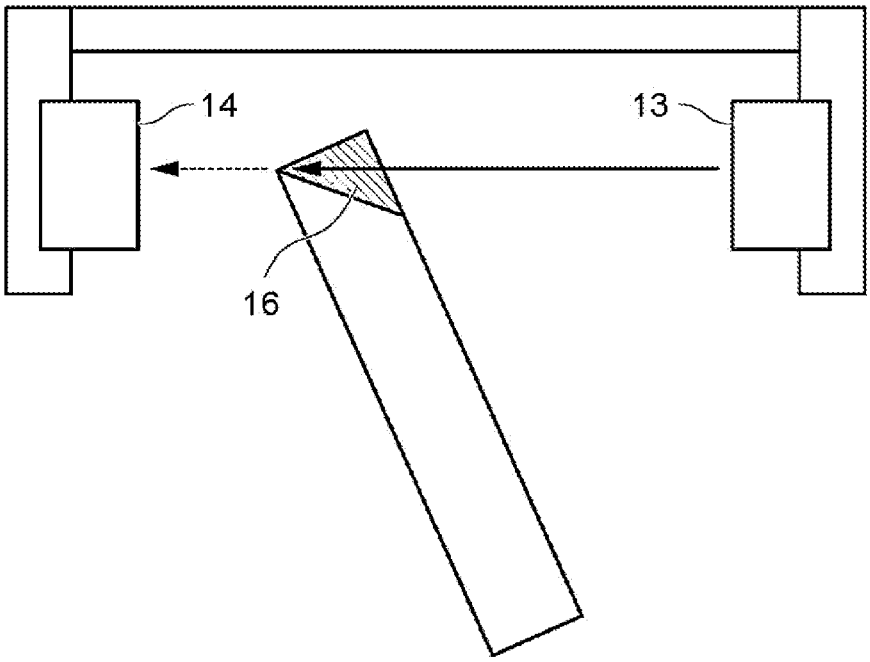
FIG. 5 is a diagram illustrating the difference corresponding to the inclination of a light shielding section 15.

First, description is given with reference to FIG. 5. FIG. 5 is a diagram illustrating a specific example of a case in which only the light transmissive part 16 intersects with the light passage 17.

As shown in FIG. 5, the light transmissive part 16 of the light shielding section 15 intersects with the light passage 17. Such a state occurs in a case in which the thickness of the residual quantity of the sheets 11 is smaller than the first threshold value. In this case, the light emitted from the light emitting section 13 is attenuated by the light transmissive part 16. Then the attenuated light is received by the light receiving section 14. The voltage level detected by the light receiving section 14 in this case is lower than the voltage level detected by the light receiving section 14 which receives the light that is not attenuated.

The description about a case in which only the light transmissive part 16 intersects with the light passage 17 is terminated.

Figure 6:
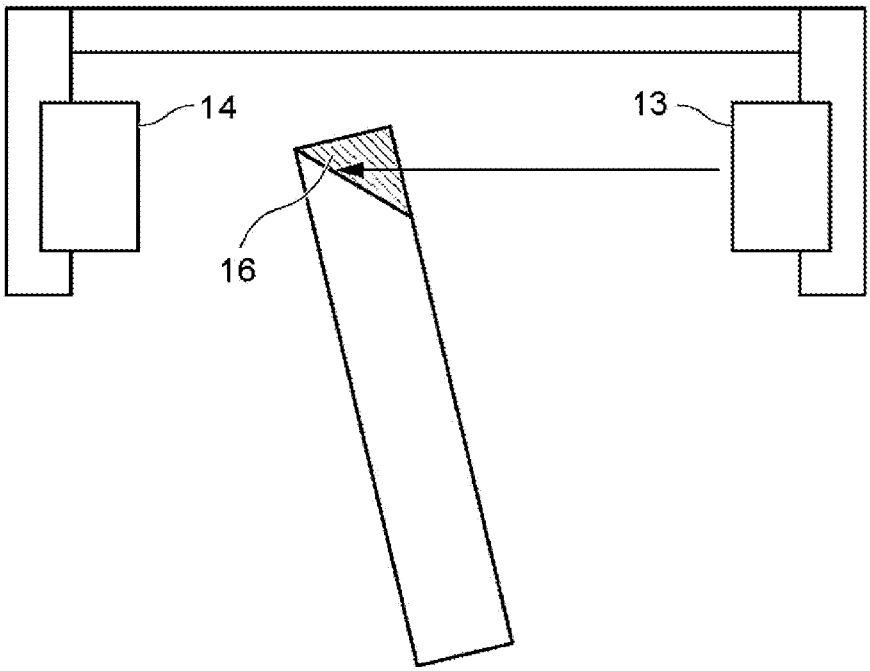
FIG. 6 is a diagram illustrating the difference corresponding to the inclination of a light shielding section 15.

Next, description is given with reference to FIG. 6. FIG. 6 is a diagram illustrating a specific example of a case in which the light transmissive part 16 and the light shielding part intersect with the light passage 17.

As shown in FIG. 6, the light transmissive part 16 and the light shielding part intersect with the light passage 17. Such a state occurs in a case in which the thickness of the residual quantity of the sheets 11 is smaller than the second threshold value. In this case, the light emitted from the light emitting section 13 does not reach to the light receiving section 14. In this case, no voltage level is detected by the light receiving section 14.

The description about a case in which the light transmissive part 16 and the light shielding part intersect with the light passage 17 is terminated.

Figure 7:
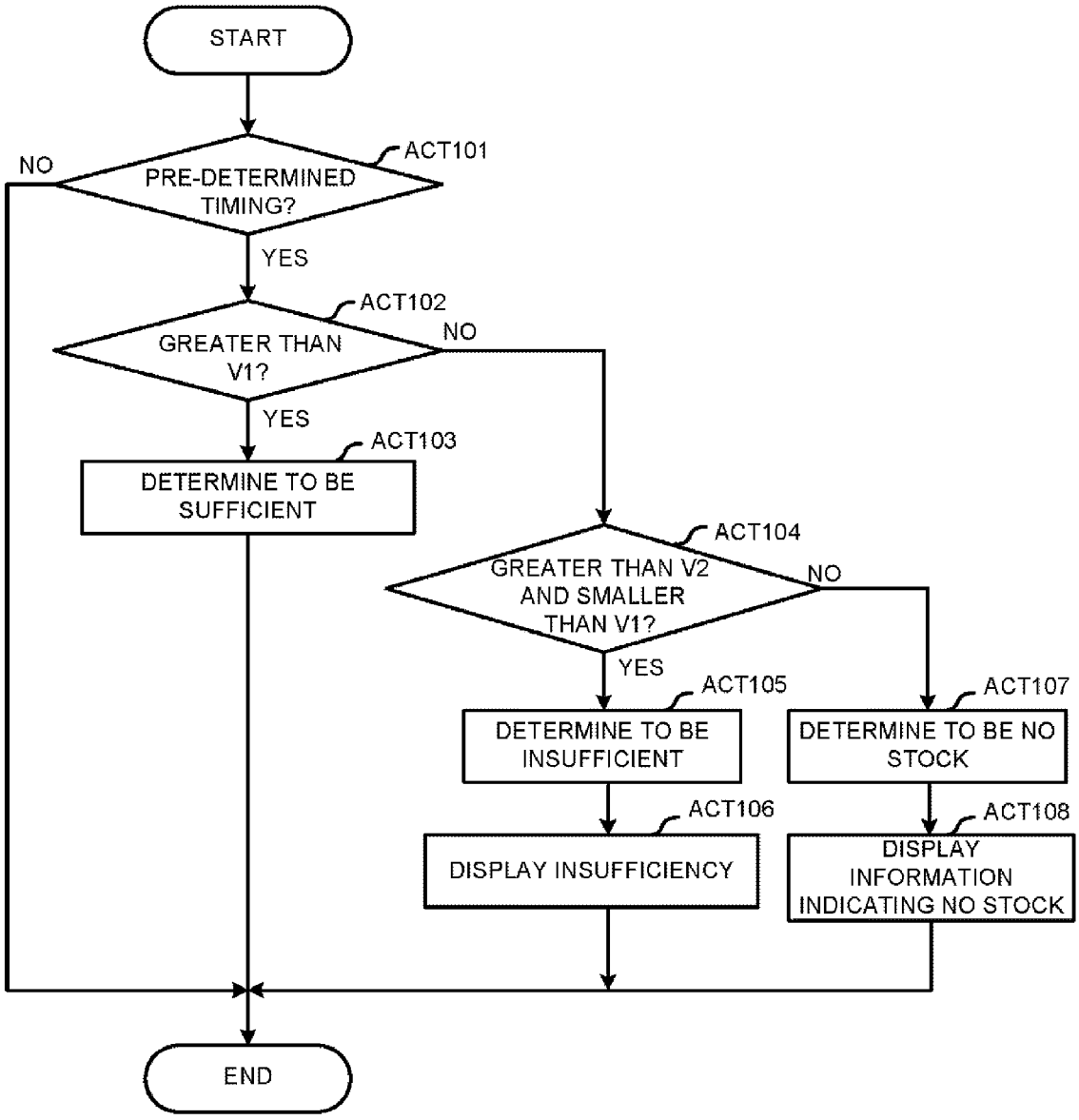
FIG. 7 is a flowchart illustrating the operation of the printing apparatus 1.

FIG. 7 is a flowchart illustrating the operation of the printing apparatus 1. The processing in FIG. 7 is carried out at pre-determined timing. Further, a case in which the determination information table shown in FIG. 4 is stored in the determination information storage section 202 is exemplified.

The determination section 201 determines whether or not it is the pre-determined timing (ACT 101). If it is not the pre-determined timing (NO in ACT 101), the printing apparatus 1 terminates the processing.

On the other hand, if it is the pre-determined timing (YES in ACT 101), the determination section 201 confirms the voltage level detected by the light receiving section 14 to acquire the information of the voltage level. The determination section 201 carries out a determination corresponding to the acquired voltage level with reference to the determination information table stored in the determination information storage section 202. Specifically, the determination section 201 determines whether or not the acquired voltage level is greater than V1 (ACT 102). If the voltage level is greater than V1 (YES in ACT 102), the determination section 201 determines the residual quantity of the sheets from the associated determination result with reference to the determination information table. In this case, the determination section 201 determines that the residual quantity of the sheets is sufficient (ACT 103). Then the printing apparatus 1 terminates the processing.

On the other hand, if the voltage level is smaller than V1 (NO in ACT 102), the determination section 201 determines whether or not the acquired voltage level is greater than V2 and smaller than V1 (ACT 104). If the voltage level is greater than V2 and smaller than V1 (YES in ACT 104), the determination section 201 determines the residual quantity of the sheets from the associated determination result with reference to the determination information table. In this case, the determination section 201 determines that the residual quantity of the sheets is insufficient (ACT 105). Then the determination section 201 outputs the determination result to the control section 203. The control section 203 controls to display a character string indicating that the residual quantity of the sheets is insufficient on the display section 300. The display section 300 displays the character string indicating that the residual quantity of the sheets is insufficient under the control of the control section 203 (ACT 106). The character string indicating insufficiency may be, for example, "The stock of sheets is insufficient. Please replenish sheets as soon as possible".

On the other hand, if the voltage level is smaller than V2 (NO in ACT 104), the determination section 201 determines the residual quantity of the sheets from the associated determination result with reference to the determination information table. In this case, the determination section 201 determines that there is no stock of sheet (ACT 107). Then the determination section 201 outputs the determination result to the control section 203. The control section 203 controls to display a character string indicating that there is no stock of sheet on the display section 300. The display section 300 displays the character string indicating that there is no stock of sheet under the control of the control section 203 (ACT 108). The character string indicating that there is no stock of sheet may be, for example, "Paper out. Please replenish sheets". Then the printing apparatus 1 terminates the processing.

In the printing apparatus 1 with such a constitution, the residual quantity of the sheets 11 is determined according to the voltage level detected by the light receiving section 14. For example, in a case in which the voltage level is greater than V1, it is determined that the residual quantity is sufficient. In a case in which the voltage level is greater than V2 and smaller than V1, it is determined that the residual quantity is insufficient. In a case in which the voltage level is smaller than V2, it is determined that there is no residual quantity. Thus, the printing apparatus 1 can detect the degree of the residual quantity of the sheets 11. In this way, the user can be notified before the sheets 11 are used up. As a result, it is possible to prevent the downtime which occurs because the sheets 11 are not replenished until the sheets 11 stored on sheet feed tray 10 are used up.

The printing apparatus 1 is provided with the light shielding section 15 which changes in inclination according to the residual quantity of the sheets 11 and is equipped with the light transmissive part 16. With the light shielding section 15, the light emitted from the light emitting section 13 transmits, and the quantity of the light is reduced. Thus, the voltage level detected by the light receiving section 14 can be changed.

Next, a modification of the printing apparatus 1 is described.

The printing apparatus 1 is exemplified in the present embodiment; however, the technology in the present embodiment may be applied to other apparatuses. For example, it can be applied to an image forming apparatus such as a MFP (Multi Function Peripheral) and the like.

It is exemplified in the present embodiment that the determination result of the determination section 201 is displayed on the display section 300; however, the printing apparatus 1 may notify the determination result. In a case of such a constitution, the printing apparatus 1 is provided with a notification section. The notification section notifies the determination result through a speech under the control of the control section 203. The notification section may be, for example, a speech output device such as a speaker and the like. Hereinafter, the processing in such a case is described. If it is determined by the determination section 201 that the residual quantity of the sheets 11 is insufficient, the control section 203 controls to notify a character string indicating that the residual quantity of the sheets 11 is insufficient by the notification section through a speech. The notification section notifies the character string indicating that the residual quantity of the sheets 11 is insufficient through a speech under the control of the control section 203. For example, the notification section notifies a character string "The stock of sheets is insufficient. Please replenish sheets as soon as possible" through a speech.

If it is determined by the determination section 201 that there is no residual quantity of the sheets 11, the control section 203 controls to notify a character string indicating that there is no residual quantity of the sheets 11 by the notification section through a speech. The notification section notifies the character string indicating that there is no residual quantity of the sheets 11 through a speech under the control of the control section 203. For example, the notification section notifies a character string "Paper out. Please replenish sheets" through a speech. Incidentally, the notification section may notify different speeches in a case in which the residual quantity of the sheets 11 is insufficient and in a case in which there is no residual quantity of the sheets 11.

With such a constitution, the user can be notified of the determination result through a speech. Thus, more users can be notified of the information relating to the residual quantity of the sheets 11. In this way, the fear that the sheets 11 are not replenished until the sheets 11 stored on sheet feed tray 10 are used up is reduced, which can prevent the downtime.

The printing apparatus 1 may notify the determination result through both display and speech. In this case, the printing apparatus 1 displays the determination result on the display section 300 and meanwhile notifies the displayed content through a speech.

It is exemplified in the present embodiment that the degree of the residual quantity of the sheets 11 determined by the determination section 201 includes three stages: sufficient, insufficient and no stock; however, it is not limited to this. For example, the determination section 201 may determine the degree of the residual quantity of the sheets 11 by four or more stages.

The constitution of the light transmissive part 16 is not limited to the constitution (triangular constitution) shown in FIG. 2. For example, the light transmissive part 16 may be constituted in a fan shape or other shapes.

The arrangement position of the light transmissive part 16 is not limited to the position described above. For example, the light transmissive part 16 may be arranged at any position as long as it meets the following two points. Point 1: the light transmissive part 16 is arranged at one end of the light shielding section 15. Point 2: the light transmissive part 16 intersects with the light passage 17, or the light transmissive part 16 and the light shielding part intersect with the light passage 17 according to the inclination of the light shielding section 15.

In accordance with at least one embodiment described above, the printing apparatus is provided with a light receiving section for detecting the voltage level corresponding to the quantity of the received light and a determination section for determining the residual quantity of the sheets according to the detected voltage level, in this way, the degree of the residual quantity of the sheets can be detected.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a light receiving section configured to receive light emitted from a light emitting section which emits light, and detect a voltage level corresponding to a quantity of the received light;

a determination section configured to determine a residual quantity of sheets according to the detected voltage level;

a printing section configured to carry out printing on a sheet; and a light shielding section, which is equipped with a light transmissive part through which light can be transmitted, configured between the light emitting section and the light receiving section to change in inclination according to the residual quantity of the sheets; wherein the light shielding section changes the quantity of the light received from the light emitting section according to the inclination thereof; and the determination section determines that the residual quantity of the sheets is insufficient in a case in which the voltage level is smaller than a pre-determined value.

2. The printing apparatus according to claim 1, wherein the light transmissive part is located at a position where it does not intersect with a light passage serving as a passage of the light in a case in which the thickness of the residual quantity of the sheets is greater than a first threshold value, and is located at a position where it intersects with the light passage in a case in which the thickness of the residual quantity of the sheets is smaller than the first threshold value.

3. The printing apparatus according to claim 2, wherein the light transmissive part is located at a position where it intersects with the light passage in a case in which the thickness of the residual quantity of the sheets is greater than a second threshold value and smaller than the first threshold value.

4. The printing apparatus according to claim 3, wherein the light shielding section shields the light in a case in which the thickness of the residual quantity of the sheets is smaller than the second threshold value.

5. The printing apparatus according to claim 1, further comprising:

a storage section configured to store a condition relating to the voltage level and an index indicating the residual quantity of the sheets in an associated manner; wherein the determination section determines, if the condition is met, the residual quantity of the sheets according to the index associated with the met condition.

6. The printing apparatus according to claim 1, further comprising:

a display section configured to display a determination result of the determination section.

7. The printing apparatus according to claim 1, further comprising:

a notification section configured to notify the determination result of the determination section.

8. A sheet residual quantity determination method including:

receiving light emitted from a light emitting section which emits light, and detecting a voltage level corresponding to the quantity of the received light;

determining the residual quantity of sheets according to the detected voltage level, wherein the residual quantity of the sheets is determined to be insufficient in a case in which the voltage level is smaller than a predetermined value;

carrying out printing on a sheet; and changing in inclination of a light transmissive part of a light shielding section, according to the residual quantity of sheets, to change the quantity of the light received from the light emitting section according to the inclination thereof.

9. A non-transitory computer readable recording medium storing a computer program which enables a computer to execute the following processing:

receiving light emitted from a light emitting section which emits light, and detecting a voltage level corresponding to a quantity of the received light;

determining a residual quantity of sheets according to the detected voltage level, wherein the residual quantity of the sheets is determined to be insufficient in a case in which the voltage level is smaller than a pre-determined value;

carrying out printing on a sheet; and changing in inclination of a light transmissive part of a light shielding section, according to the residual quantity of the sheets, to change the quantity of the light received from the light emitting section according to the inclination thereof.

10. The sheet residual quantity determination method according to claim 8, wherein the light transmissive part is located at a position where it does not intersect with a light passage serving as a passage of the light in a case in which the thickness of the residual quantity of the sheets is greater than a first threshold value, and is located at a position where it intersects with the light passage in a case in which the thickness of the residual quantity of the sheets is smaller than the first threshold value.

11. The sheet residual quantity determination method according to claim 10, wherein the light transmissive part is located at a position where it intersects with the light passage in a case in which the thickness of the residual quantity of the sheets is greater than a second threshold value and smaller than the first threshold value.

12. The sheet residual quantity determination method according to claim 11, wherein the light shielding section shields the light in a case in which the thickness of the residual quantity of the sheets is smaller than the second threshold value.

* * * * *